United States Patent [19]

Widmayer

[11] Patent Number: 4,766,352

[45] Date of Patent: Aug. 23, 1988

[54] METHOD AND APPARATUS FOR STARTING AND OPERATING FLUORESCENT LAMP AND AUXILIARY BALLAST SYSTEMS AT REDUCED POWER LEVELS

[76] Inventor: Don F. Widmayer, 4704 Locust Hill Rd., Bethesda, Md. 20814

[21] Appl. No.: 769,829

[22] Filed: Aug. 27, 1985

[51] Int. Cl.[4] ..... H05B 37/00

[52] U.S. Cl. ..... 315/244; 315/239; 315/275; 315/279

[58] Field of Search ..... 315/244, 245, 239, 275, 315/279, DIG. 5, 278

[56] References Cited

U.S. PATENT DOCUMENTS

| | | | |
|---|---|---|---|
| 3,418,527 | 12/1968 | Miller | 315/244 |
| 3,500,128 | 3/1970 | Liepins | 315/278 |
| 4,082,981 | 4/1978 | Morton et al. | 315/DIG. 5 X |
| 4,185,233 | 1/1980 | Riesland et al. | 315/245 X |
| 4,388,564 | 6/1983 | Hammer | 315/245 X |
| 4,399,391 | 8/1983 | Hammer et al. | 315/244 |
| 4,523,795 | 6/1985 | Johnson et al. | 315/244 X |
| 4,553,071 | 11/1985 | Boyd | 315/244 |

FOREIGN PATENT DOCUMENTS

| | | | |
|---|---|---|---|
| 2949074 | 6/1981 | Fed. Rep. of Germany | 315/244 |

OTHER PUBLICATIONS

Kelly, George "The Ferroresonant Circuit" 7/30/58 26–31, 1958 AIEE Fall Meeting, Pittsburgh, Pa.

Salihi, Jalal "Theory of Ferroresonance" Jan. 1960, AIEE and Air Transportation Conference, Seattle, Wash. 6/21/59.

*Primary Examiner*—David K. Moore

*Attorney, Agent, or Firm*—Larson and Taylor

[57] ABSTRACT

A low cost circuit addition in the form of a capacitor of suitable value provides effective starting and operation of rapid start, preheat, and instant start fluorescent type gas discharge lamps along with their standard A.C. operated ballast transformer auxiliary devices at reduced power levels to achieve energy conservation with a concomitant reduction in light output and can usefully employed in illuminated areas where a reduction in lighting level would not effect the utility of that particular area. The capacitor is connected in series with the ballast primary winding and is of such value as to cause ferro-resonance to occur in the ballast transformer primary circuit, thereby providing a voltage magnification effect to aid the lamp starting, or ignition, process i.e., during the time interval between circuit energization and production of a stable arc, and to thereafter operation of the lamp with reduced arc current.

11 Claims, 3 Drawing Sheets

METHOD AND APPARATUS FOR STARTING AND OPERATING FLUORESCENT LAMP AND AUXILIARY BALLAST SYSTEMS AT REDUCED POWER LEVELS

FIELD OF THE INVENTION

The present invention relates to the control of ballasted fluorescent lamps and more particularly to apparatus for controlling starting and providing operation of such lamps at reduced power levels.

BACKGROUND OF THE INVENTION AND PRIOR ART

Fluorescent lamps of the type which use A.C. line operated ballast transformer auxiliaries are widely used in commercial and institutional buildings for illumination purposes. These buildings are generally overlit to insure that adequate light will be present for the worst case set of conditions, i.e., for night-time use with lumen depreciated, i.e., worn out, lamps or by a person having well below average visual acuity doing tasks requiring high lighting levels. Such overlighting can, of course, be reduced after it is determined what specific light levels are required for the tasks to be performed after a building is occupied. However, when standard ballasts and lamps are installed on a fixed distance ceiling grid, it is not always possible to reduce the lighting levels to those which meet minimum requirements and are also economical. For example, suppose a hallway has nominally 80 footcandles of conventional fluorescent lighting and it is later found that 10 to 20 footcandles would be adequate. The lighting level could be reduced approximately 15% with lower wattage "energy saving" lamps, i.e., standard 34 watt lamps, or by removing some of the lamps to reduce light levels. The latter unfortunately produces what is sometimes called "peak-and-valley" lighting. This type of lighting presents safety problems if for no other reason than the distance between the "on" lamps is increased so a light-dark or "peak-and-valley" lighting pattern is established.

The preferred approach is to keep all lamps "on" but, at a reduced power, thus reducing the light output level. The prior art includes a number of devices which permit some or all lamps to be operated at reduced power and light output levels. These devices are, however, generally limited to reducing the energy consumed to a maximum of 50% with a similar reduction in light output.

Manufacturers of this type of so-called "⅓" or "½" (33% and 50% reduction) "power reducers" usually accomplish this reduction by placing a capacitor (whose value determines amount of reduction) in series with one of the ballast transformer secondary leads and one of the lamp electrodes. However, if the lamp is of the rapid start fluorescent lamp type, such a connection is not possible due to the fact that the lamp electrode requires a two-wire path from a low voltage transformer winding which is close coupled to the ballast transformer primary. In particular, the connection in the secondary circuit of the ballast transformer cannot be because the case of the device is sealed, and to overcome this problem, prior art manufacturers add an external nominal 1:1 isolation transformer in series combination with the capacitor. This approach is more fully described in U.S. Pat. No. 3,954,316 (Luchetta et al). The need to add the isolation transformer also complicates the installation in that two of the ballast transformer secondary circuit wires (those going to the lamp) must be cut, and the insulation removed from the four ends, so the power reducer device can be connected. In addition, if the capacitor value is such that the current is limited to reduce energy consumption more than a nominal 50% of the rated energy consumption, the lamp will not ignite. Therefore, this type of secondary-installed "power reducer" is limited to capacitor values whose current limiting contribution does not inhibit lamp firing, i.e., those providing a nominal 50% reduction.

Other patents of possible interest include: U.S. Pat. Nos. 2,695,375 (Mendenhall et al); 3,235,769 (Wattenbach); 3,836,816 (Heck); 4,185,233 (Riesland); 4,207,497 (Capewell et al); 4,275,337 (Knoble et al); 4,399,391 (Hammer et al); and 4,496,880 (Luck).

SUMMARY OF THE INVENTION

The present invention relates generally to the starting and operation of fluorescent lamps with transformer ballast type auxiliaries driven by an A.C. voltage source power supply. The invention involves the provision of a range of low cost circuit insertion devices which, when connected in appropriate circuit relationship with the A.C. voltage supply and the primary winding of an existing ballast transformer, will reduce the energy consumption of the standard lamp-ballast transformer combination with a concomitant reduction of the light output. The invention also provides reliable starting of the fluorescent lamps in a manner conducive to long lamp life, limits the ballast and lamp current in relationship to the amount of desired energy consumption reduction, and contributes in a beneficial way to the overall electrical system power factor of a building or other installation as well as reduces lumen output depreciation of the lamps, cathode "sputtering" and the operating temperature of the ballast so as to extend the useful life of both ballast and lamps. These objects and advantages are achieved by exploiting the phenomena of ferroresonance as discussed below.

In accordance with a preferred embodiment of the invention, a lamp-ballast system is provided comprising an A.C. voltage source, a ballast transformer having a primary winding connected to the A.C. source, and at least one secondary winding, at least one rapid start fluorescent lamp connected to the at least one secondary winding and including at least one cathode heater winding powered from the ballast transformer, wherein, in accordance with the invention, a capacitor is connected in series between the A.C. source and the primary winding of the ballast transformer which has a capacitance value such as to produce ferroresonance and a resultant jump increase in the value of the ballast transformer voltage at a given value of the voltage applied by the A.C. voltage source so that a sufficient voltage is provided for the at least one cathode heater winding to provide heating of the lamp cathodes while providing ignition, and operation, of the lamp at a reduced arc current level.

Other features and advantages of the present invention will be set forth, or apparent from, the detailed description of the preferred embodiments which follows.

DESCRIPTION OF THE PREFERRED EMBODIMENTS

Figure 1:
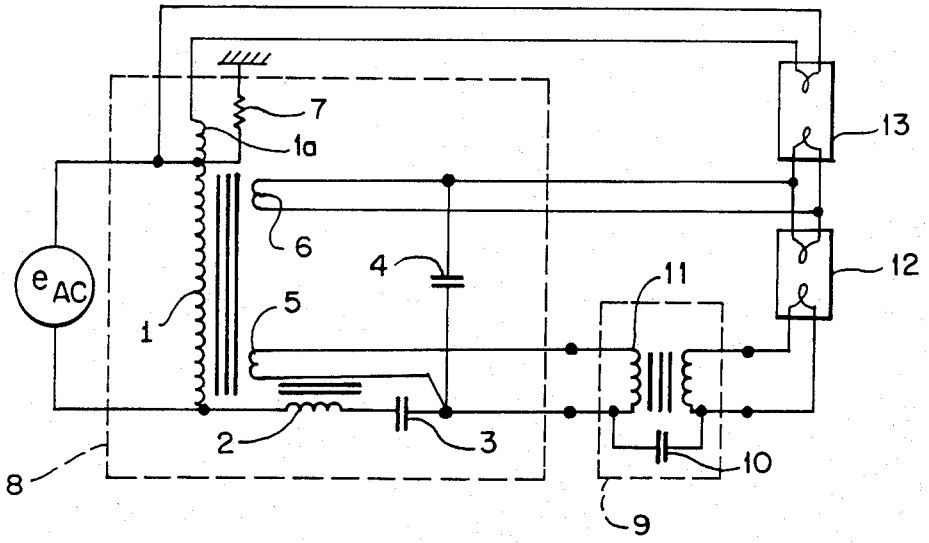
FIG. 1 PRIOR ART
FIG. 1 is a schematic circuit diagram of a prior art power reducer and ballast circuit.

Before considering the present invention, reference will be made to FIG. 1, which is generalized schematic circuit diagram of a prior art "power reducer" of the type which was discussed above, and which is disclosed in the Luchetta patent referred to above. The circuit includes an A.C. source $e_{AC}$, a ballast transformer primary winding 1, a nominal three-volt autotransformer filament cathode heating winding 1a, a secondary winding 2, a power factor correction capacitor 3 connected in series with secondary winding 2, a starting aid capacitor 4, a pair of isolated, closely coupled filament cathode heater windings 5 and 6 (at nominally three volts), and a resistor 7 which is connected to ground. These components 1 to 7 form the basic ballast unit 8 for a pair of lamps 12 and 13. The "power reducer" device, which is denoted 9, comprises a 1:1 isolation transformer 11 connected as shown between ballast unit 8 and the lamp 12, and a capacitor 10 connected between the primary and secondary windings of the transformer 11. The disavantages of this approach were discussed above and this discussion will not be repeated here.

Further insight to the operation of a fluorescent lamp and ballast transformer systems may be useful in understanding the instant invention. In North America, the majority of fluorescent lamps employed are of the rapid-start class with transformer type ballasts, due to the prevalence of 120 V AC distribution. These lamps employ an oxide coated electrode at each end of the lamp which alternates between functioning as a cathode or anode, depending on the alternating polarity of the A.C. line. These electrodes (cathodes) must be heated to a temperature sufficient to provide an adequate level of thermionic electron emission and, in particular, a saturation thermionic emission current which must be greater at all times than the instantaneous peak of the lamp arc alternating current, in order to prevent the phenomenon of cathode "sputtering". Because such sputtering decreases lamp life, proper cathode heating of rapid-start lamps, as well as pre-heat lamps (whose firing depends on external heating of the lamp cathodes prior to ignition), is required if normal, much less extended, lamp life is to be obtained.

Figure 2:
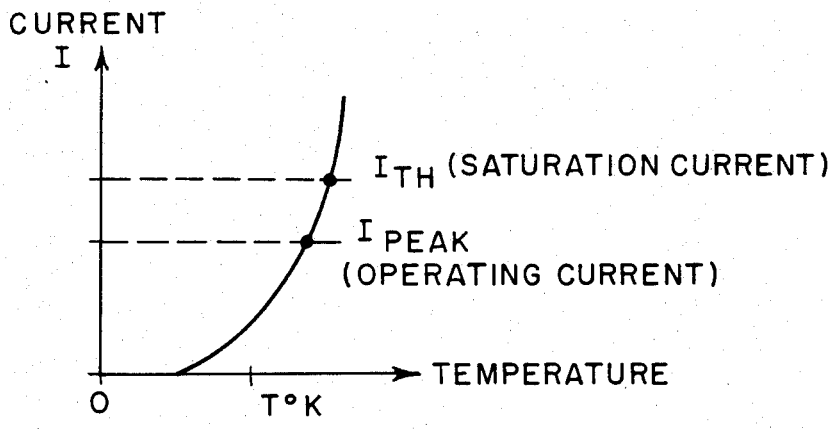
FIG. 2 is a plot of current as a function of the emission of the cathode as a function of the temperature of the cathode showing the relationship of the cathode emission to the peak operating current of a lamp arc.

Referring to FIG. 2, this figure conceptually illustrates the emission characteristic as a function of the temperature of an oxide coated cathode as well as illustrates the fact that the saturation current ($I_{TH}$) must always exceed the peak arc current. Failure to achieve this relationship will cause lamp life shortening cathode sputtering wherein the cathodes will physically emit material forming the cathode. This is evidenced by darkening at the ends of the lamp resulting from the cathode sputtered material being redeposited on the inside of the lamp tube. This overall process leads to an effect termed cathode "poisoning" and thus limits the useful lifetime of the lamp. Thus, as stated, improper cathode heating will shorten lamp life. Two references relating to electron emission are Chapter 17 of *Reference Data for Radio Engineers* (Sixth Edition), published by Howard W. Sams & Co., New York, 1977, and *Electronics* by Jacob Millman, Ph.D. and Samuel Seely, Ph.D. published by McGraw-Hill Book Company, Inc., 1951.

Cathode sputtering always occurs during the starting of fluorescent lamps due to "firing" before the available level of saturation thermionic emission current ($I_{TH}$) exceeds the arc operating current. Thus a lamp which is turned on and off frequently will have a shorter useful life than a lamp which operates continuously. Similarly, a lamp whose cathodes are first heated sufficiently to achieve a saturation thermionic emission current $I_{TH}$) greater than the available peak arc current and are then operated at a reduced arc current level will experience reduced "sputtering" and therefore have a longer life.

As discussed above, the instant invention exploits the ferroresonance effect, a phenomena which is complex and is not widely understood. The 1975 Second Edition of the IEEE Standard Dictionary of Electrical and Electronics Terms, on page 253, defines ferroresonance (transformer): "A phenomenon usually characterized by overvoltages and very irregular wave shapes and associated with the excitation of one or more saturable inductors through capacitance in series with the inductor".

The phenomena of ferroresonance has been studied sporadically over the years starting with the pioneering work of Guy Suits at the GE Research Laboratory in the 1930's. The literature is replete with phenomenological and analytical explanations of this general class of non-linear operation in A.C. circuits. Two papers which provide useful insight of a more current vintage are *The Ferroresonant Circuit* by George E. Kelly, Jr., January 1959 AIEE Transactions, Part I, Communications and Electronics, and the *Theory of Ferroresonance*, Jalal T. Salihi, January 1960 AIEE Transactions, Part I, Communications and Electronics. The Kelly paper focuses on the adverse effects of ferroresonance in A.C. power systems and is more phenomenologically oriented, with an emphasis on practical matters of implementation and observations. The Salihi paper is more theoretically oriented and provides a useful idealized analysis of the complex operation inherent in ferroresonant operation for the case of so-called "square loop" magnetic core materials. Together these two references provide a useful basis for understanding the operating modes described below.

Figure 3:
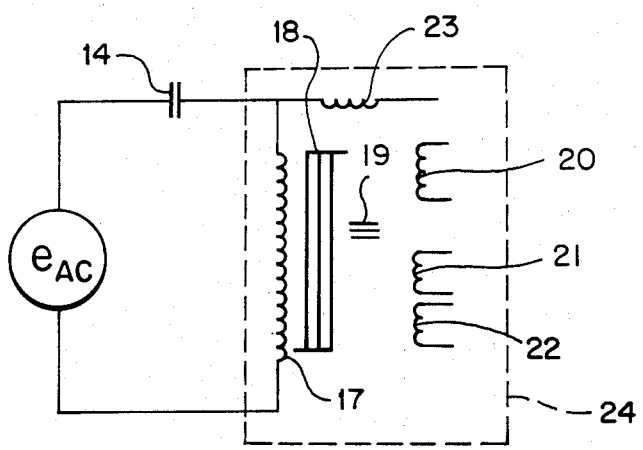
FIG. 3 is a schematic circuit diagram of a "generic" ballast transformer (without lamps) incorporating the invention.

Turning now to the present invention, and referring to FIG. 3, a generic representation is provided of a ballast transformer system incorporating the invention. The system includes an A.C. source, denoted $E_{AC}$, a transformer primary winding 17, a core 18, a shunt 19 (providing loose coupling), a secondary winding 20, and heater windings 21, 22 and 23, all of which form a ferromagnetic core ballast transformer auxilliary 24 suitable for operating gas discharge lamps. This part of the system is conventional and the invention involves connection of a critically valued capacitor 14 in series with the voltage source $e_{AC}$ and the primary winding 17 of the ballast transformer 24. Capacitor 14 must be large enough that ferroresonance will occur. On the other hand, if capacitor 14 is of too large a value, the benefits of the present invention will be decreased or lost. The circuit dynamics are complicated because the ferroresonance effect is dependent upon saturation operation of the ferromagnetic core. The latter depends upon the voltage-time integral (i.e., flux) state observed across the primary winding. Thus, while the instant invention is "structurally" simple, the circuit operation involved is quite complex.

In the course of empirical tests and measurements conducted with a capacitor covering a range of values and connected in series with the primary winding of a ballast-transformer for two 40 watt rapid start fluorescent lamps, it has been observed that with nominal line voltage applied ($e_{AC}$ constant) to the circuit of FIG. 3, two distinct states of voltage distribution exist between the capacitor 14 and primary winding 17, depending upon the loading of the ballast transformer secondary windings. One state is that for the unloaded condition, i.e., with the windings effectively open circuited, while the other is that for a load characteristic of "fired" lamps. For example, it was found that the voltage for ballast transformer primary winding 17 is significantly higher than the voltage provided by the A.C. source $e_{AC}$ when no loading is present (either no lamps in the circuit or during the pre-lamp ignition time interval) and that after arc ignition (i.e, with the lamps in the circuit), the ballast transformer primary winding voltage is between 70% and 80% of the nominal value of the A.C. line voltage. Thus excellent lamp ignition, i.e., starting, properties are available, with sufficient arc sustaining current and cathode terminal heating voltage remaining after stable lamp arc ignition has occurred.

Figure 4:
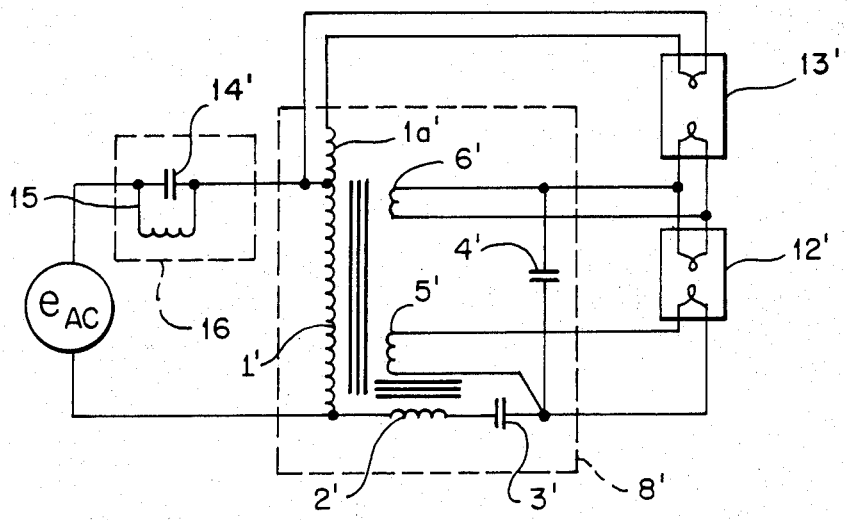
FIG. 4 is a schematic circuit diagram of a preferred embodiment of the invention wherein a series connected capacitor of suitable valve is employed to induce ferroresonance.

Referring to FIG. 4, a schematic circuit diagram of a preferred embodiment of the invention is provided. The voltage source $e_{AC}$ again represents the A.C. line voltage, which is usually either 120 or 277 VAC in the United States, although other line voltages can be used, and are used in other countries. The overall circuit of FIG. 4 is similar to that of FIG. 1 and similar components have been given the same reference numerals with primes attached. The block 8' represents a standard ballast transformer driving two 40 watt rapid start fluorescent lamps 12', 13', and a block 16 comprises a circuit insertion device consisting of a critically valued capacitor 14' and an optional capacitor discharge resistor 15 for discharging any residual capacitive stored energy upon circuit de-energization.

Figure 5A:
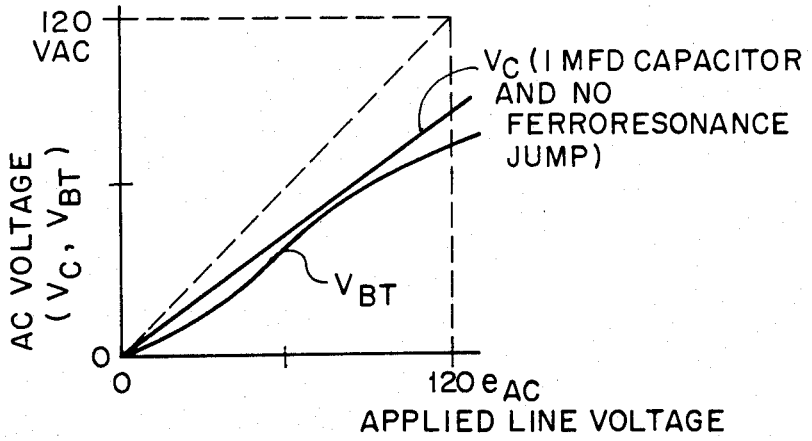
FIG. 5A is a plot of voltage distribution (capacitor and ballast transformer voltages as a function of the applied line voltage) without ferroresonance.
Figure 5B:
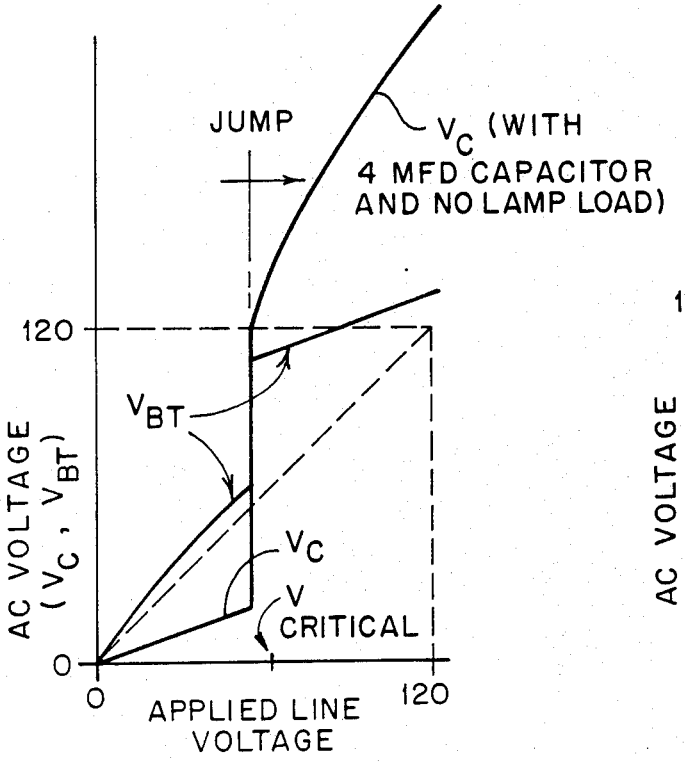
FIG. 5B is a plot of voltage distribution similar to FIG. 5A, with ferroresonance and without a lamp arc load.
Figure 5C:
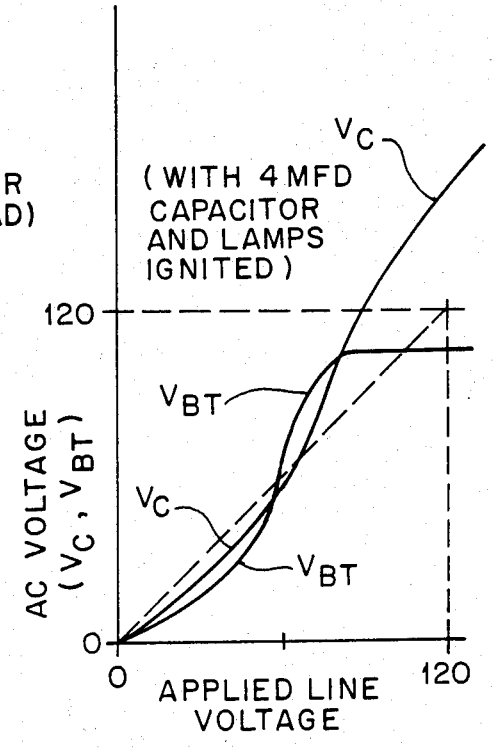
FIG. 5C is a plot of voltage distribution similar to that of FIGS. 5B, but with a lamp arc load.

FIGS. 5A, 5B and 5C respectively illustrate the voltage distribution for the generic circuit of FIG. 3 with the magnitude of the series capacitor 14 as a parameter when the applied voltage $e_{AC}$ is monotonically increased from zero to beyond the rated value of the ballast transformer primary winding 17. In particular, capacitors, corresponding to capacitor 14 and having a range of values, were series connected with the primary winding of a Universal Manufacturing Company ballast transformer (catalog no. 446-LR-TC-P labeled for 120 V operation of two 40 or 34 watt rapid start fluorescent lamps) in its unloaded (open circuit) state driven by a 0–130 V adjustable autotransformer. FIGS. 5A and 5B illustrate the voltage distribution between the capacitor 14 and the primary winding 17 of the ballast transformer without the fluorescent lamps connected to the ballast secondaries, i.e., for the unloaded condition. In FIG. 5A, there is no ferroresonance and both the capacitor voltage and ballast transformer voltage are substantially below the source voltage $e_{AC}$. FIG. 5A shows that the voltage $V_C$ on a 1 microfarad capacitor 14 increases in a relatively linear manner, along with the applied A.C. voltage. It is noted that when fluorescent lamps are used to load the ballast transformer for this capacitor value, the lamps do not start due to the insufficient amplitude of the voltage on the ballast transformer secondary winding or windings.

However, if the value of the capacitor is increased to a value that produces ferroresonance, the voltages will increase and cause lamp ignition. In FIG. 5B, the value of capacitor 14 has been increased to a value (4 microfarads) at which ferroresonance is produced and the effect of ferroresonance can be clearly observed as a jump in both voltages for a critical value of applied line voltage. The capacitor voltage $V_C$ also increases but at a rate significantly less than the applied line voltage ($e_{AC}$). Thus, as stated, at a critical applied voltage, and depending on the value of the capacitor 14, a substantial jump in both the capacitor voltage $V_C$ and ballast transformer voltage $V_{BT}$ occurs. The ballast transformer $V_{BT}$ jumps to nominally 100 V at the jump point and then shows a small increase from 100 V to nominally 130 V as the applied line voltage $e_{AC}$ is increased from nominally 60 volts to 120VAC. The capacitor voltage ($V_C$) jumps to nominally 120 VAC with the applied line voltage $e_{AC}$ at nominally 60 volts and continues to increase steeply after the voltage jump as the applied line voltage increases from nominally 60 to 120 VAC. Therefore, since the ballast transformer primary voltage ($V_B$) is at or above the applied line voltage (without loading since the fluorescent lmaps are not fired), the cathode heater voltages of rapid start ballast lamp combinations are at the high side of their tolerance and hence provide for rapid heating, and therefore produce minimal cathode "sputtering" when lamp firing occurs. Similarly, the ignition, or firing, voltage at the ballast transformer secondary is on the high side of its tolerance thereby providing good arc ignition characteristics when the fluorescent lamps are connected thereto.

Referring to FIG. 5C, a nominal 4 MFD capacitor 14 is used and the circuit is loaded by two 40 watt fluorescent lamps in a fired state. It will be noted that the primary winding ballast transformer $V_{BT}$ is reduced slightly below rated after lamp arc ignition. Furthermore, excellent regulation of the ballast transformer primary winding voltage $V_B$) is produced when the applied line voltage $e_{AC}$ is varied from 70 to 130 VAC. The current flowing in the primary circuit of the ballast transformer is leading relative to the voltage (thus providing a leading circuit power factor) and both the RMS and peak values of the current are reduced from the rated RMS and peak values of a ballast transformer-lamp combination for normal rated operation (i.e., without the benefit of the use of a critically valued series capacitor as discussed and thus without the resulting ferroresonant effect produced thereby). As the value of the capacitor 14 is increased from a value where no ferroresonance is observed, a critical value of capacitance is encountered at which the characteristic ferroresonant jump occurs. For example, measurements have shown that a jump of about 15 volts occurs on a 2 MFD capacitor, as well as on the ballast transformer with an applied line voltage of 50 VAC. When the capacitor value was changed to 3.3 MFD, the capacitor voltage ($V_C$) jumped from 35 V to 110 V and the ballast transformer jumped from 62 V to 85 V at a nominal 50 VAC of applied line voltage (VAC). All close-coupled secondary voltages jump, i.e., abruptly increase, in exact correspondence to the voltage on the ballast transformer primary. Thus, the cathode heater voltages also increase during the pre-arc ignition phase of the fluorescent lamp and thus rapid cathode heating is obtained.

Table 1 below is a table of measured electrical data covering a number of capacitors of different values used with a Universal Manufacturing Company ballast, catalog no. 446-LR-TC-P. It illustrates that different values of the series capacitor 14 provide different levels of power reduction. It was found that similar effects with minor changes occurred when equivalent ballasts of other manufacturers were used. The values of the capacitor required to obtain a suitable level of ferroresonance for stable arc control when using 277 VAC line voltages, and corresponding ballast-transformers adapted for such use, are obviously lower than the values used with 120 V ballasts. For example, the nominal 95 watt electrical load (of two 40 watt rapid start fluorescent lamps and a standard 277 VAC ballast) was reduced, by introducing the series capacitor of the invention, to 21, 39 45 and 69 watts when respective capacitor values of 1,2, 3 and 4 MFD were employed. Thus, while it is difficult to give specific values because of the variables involved, capacitance values of at least 3 MFD for 120 VAC systems and of at least 0.5 MFD for 277 VAC systems are preferred. Due to the voltage magnification effect across the capacitor, particularly during the pre-ignition phase, care must be taken to insure the capacitors have adequate voltage withstand insulation.

thermionic emission current (current $I_{TH}$ of FIG. 2) is acceptable with respect to lamp longevity. It is further noted that the reduction in the applied ballast operating voltage reduces the iron core losses while the reduced primary current leads to a reduction of the copper losses ($I^2R$) of the windings; thus the ballast transformer losses are substantially reduced. Accordingly, the ballast operates at a lower temperature (a critical life determining factor for a ballast) and, therefore, longer ballast life can be expected. The life of the lamps is further extended because of the decrease in cathode sputtering and in UV-phosphor destruction, the latter being due to the reduced arc current. Finally, the fact that the power factor of the reduced load lamp-ballast combination is leading tends to improve a overall system power factor of the building or other installation, this power factor being generally lagging in nature due to the motor load energy consumption segment.

Considering application of the instant invention to pre-heat lamps and ballasts, it will be evident that the starting benefits and other benefits described above will be present. However, it should be remembered that once the pre-heat lamps are started, the continuing requirement for cathode heating is dependent upon heating by the lamp arc, in accordance with the so-called internally heated cathode operation. Therefore, arc current reduction may have to be limited to achieve long life operation. Similarly, the heating of the cathodes in an instant start (Slimline) lamp are arc current dependent and the arc current reduction will have to be limited to achieve long life operation. Nevertheless, the instant start lamp, without a pre-heat cycle, can advantageously use the high voltage pre-ignition characteristic of the capacitor induced ferroresonance described above. The invention is also applicable to other types of

TABLE 1

| Item | Capacitor Value In MFD | Applied Line Voltage ($V_{AC}$ RMS) | Ballast XFM'R 446-LR-TC-P Primary Voltage ($V_{BT}$ RMS) | Capacitor Voltage ($V_C$ RMS) | Cathode Heater Voltage | Ballast XFM'R Primary Current ($I_{LINE}$ RMS) | Lamp Arc Peak Current | Lamp Arc Current ($I_{ARC}$ RMS) | Watts 40 Watt Lamps & Ballast XMF'R |
|---|---|---|---|---|---|---|---|---|---|
| 1[1] | 4.3 | 120 | 95 | 156 | 2.7 V | 0.26 A | 0.135 | 0.040 | 17.5 |
| 2[1] | 8.0 | 120 | 96 | 144 | 2.7 V | 0.458 | 0.280 | 0.110 | 34.2 |
| 3[1] | 12.3 | 120 | 94 | 126 | 2.6 V | 0.613 | 0.360 | 0.165 | 50.8 |
| 4[1] | 16.0 | 120 | 94 | 116 | 2.4 V | 0.734 | 0.440 | 0.225 | 58.3 |
| 5[1,2] | 0 | 120 | 120 | N/A | 2.0 V | 0.78 | 0.640 | 0.385 | 92 |
| 6 | 1.0 | 120 | 70 | 85 | 2.5 V | N/A[3] | N/A[3] | N/A[3] | N/A[3] |

NOTES:
[1]Measurements of items 1–5 were obtained with (2) 40 watt lamps (ignited) driven by a 120 VAC Universal ballast, Catalog #446-LR-TC-P.
[2]Measurements of item 5 were taken with ballast-lamps combination full-on (no capacitor in circuit).
[3]Measurements of item 6 were taken with a series capacitor of insufficient value (1 MFD) resulting in no ferroresonance jump.

In summary, due to the introduction of a series capacitor in the primary ballast winding circuit and the consequent ferroresonance effect, excellent pre-arc firing (ignition) conditions prevail in that an increase over the nominal A.C. source voltage is obtained to quickly heat the cathode (thus reducing the tendency for the cathode to sputter) and to ignite the gas discharge. This improved cathode heating and ignition results in longer cathode life, and hence lamp life, as well as provides for a high line voltage for lamp ignition purposes. After lamp ignition, the voltage applied to the ballast is automatically lowered from the A.C. line nominal level to a level which is still sufficient to provide stable arc operation and more than adequate cathode heating voltages. The latter is particularly so because the current limiting effect of the capacitor also lowers the peak lamp arc current. Consequently, a nominally lower saturation gas discharge lamps such as the HID types, among others, and their associated ballast transformers.

Although the invention has been described relative to exemplary embodiments thereof, it will be understood by those skilled in the art that variations and modifications can be effected in the exemplary embodiments without departing from the scop and spirit of the invention.

I claim:

1. In a lamp-ballast system comprising an A.C. voltage source, a ballast transformer having a primary winding connected to the A.C. voltage source and at least one secondary winding, and at least one lamp connected to said secondary winding, the improvement comprising a capacitor connected in series between the A.C. source and the primary winding of the ballast transformer and having a capacitance value such as to produce ferroresonance with the ballast transformer so as to provide, after initial energization of the lamp but prior to arc ignition, a jump increase in the value of the ballast transformer voltage for a given value of the voltage applied by the A.C. voltage source and immediately upon arc ignition, a lowering of the voltage applied to the primary winding of the ballast transformer to a regulated level sufficient to provide stable arc operation, and so as to provide continuous regulation thereafter at a substantially constant voltage level.

2. A system as claimed in claim 1 wherein a resistor is connected in shunt with said capacitor to provide a capacitor discharge path.

3. A system as claimed in claim 1 wherein the value of said capacitor is the minimum at which ferroresonance is produced.

4. In a lamp-ballast system, comprising an A.C. voltage source, a ballast transformer having a primary winding connected to said A.C. source and at least one secondary winding, at least one rapid start fluorescent lamp connected to said at least one secondary winding and including at least one cathode heater winding powered from said ballast transformer, the improvement comprising a capacitor connected in series between the A.C. source and the primary winding of the ballast transformer and having a capacitance value such as to produce ferroresonance and a resultant jump increase in the value of the ballast transformer voltage at a given value of the voltage applied by the A.C. voltage source so that a sufficient voltage is provided for the at least one cathode heater winding to provide heating of the lamp cathode while providing ignition of the lamp at a reduced arc current level.

5. A system as claimed in claim 4 wherein a resistor connected in shunt with said capacitor to provide a capacitor discharge path.

6. A system as claimed in claim 4 wherein the value of said capacitor is the minimum at which ferroresonance is produced.

7. A system as claimed in claim 4 wherein the at least one lamp comprises two 40 watt lamps driven by 120 VAC ballast and the value of said capacitor is at least 3 microfarads.

8. A system as claimed in claim 4 wherein the at least one lamp comprises two 40 watt lamps driven by a 277 VAC ballast and the value of said capacitor is at least 0.5 microfarads.

9. A method of operating a transformer-lamp system comprising an A.C. voltage source; a ballast transformer comprising a primary winding connected to said A.C. source and at least one secondary winding; and at least one rapid start fluorescent lamp connected to said least one secondary winding and including at least one cathode heater winding powered from said ballast transformer, said method comprising connecting a capacitor, in series between the A.C. source and the primary winding of the ballast transformer, of a value sufficient to produce ferroresonance with the ballast transformer so as to produce an abrupt increase in the transformer ballast voltage at a given value of the voltage applied from the A.C. voltage source, so as to provide adequate heating of the lamp cathodes and to provide ignition of the lamp and operation of the lamp at a reduced arc current level.

10. A system as claimed in claim 9 wherein a resistor is connected in shunt with said capacitor to provide a capacitor discharge path.

11. A system as claimed in claim 9 wherein the value of said capacitor is the minimum at which ferroresonance is produced.

* * * * *